US009592985B2

(12) United States Patent
Izawa et al.

(10) Patent No.: US 9,592,985 B2
(45) Date of Patent: Mar. 14, 2017

(54) WINDING APPARATUS

(71) Applicants: Hideo Izawa, Narashino (JP); Yuuichi Yamazaki, Narashino (JP); Kouichi Ooyama, Yokote (JP); Masaru Kusanagi, Yokote (JP)

(72) Inventors: Hideo Izawa, Narashino (JP); Yuuichi Yamazaki, Narashino (JP); Kouichi Ooyama, Yokote (JP); Masaru Kusanagi, Yokote (JP)

(73) Assignee: MIYAKOSHI PRINTING MACHINERY CO., LTD., Narashino-shi (JP)

( * ) Notice: Subject to any disclaimer, the term of this patent is extended or adjusted under 35 U.S.C. 154(b) by 208 days.

(21) Appl. No.: 14/173,871

(22) Filed: Feb. 6, 2014

(65) Prior Publication Data

US 2014/0231572 A1 Aug. 21, 2014

(30) Foreign Application Priority Data

Feb. 15, 2013 (JP) ..... 2013-027391

(51) Int. Cl.

*B65H 18/26* (2006.01)
*B65H 27/00* (2006.01)
*B65H 18/10* (2006.01)

(52) U.S. Cl.

CPC ..... *B65H 18/26* (2013.01); *B65H 18/10* (2013.01); *B65H 27/00* (2013.01);
(Continued)

(58) Field of Classification Search

CPC ..... B65H 15/60; B65H 18/16; B65H 23/24; B65H 2404/43; B65H 2405/111; B65H 18/10; B65H 18/26; B65H 27/00
(Continued)

(56) References Cited

U.S. PATENT DOCUMENTS 402,551 A * 4/1889 Winn ..... B65H 29/006 242/528
4,706,586 A * 11/1987 Vogt ..... D05B 41/00 112/470.36

(Continued)

FOREIGN PATENT DOCUMENTS

DE 4447032 A1 7/1996
JP S51-34366 A 3/1976

(Continued)

OTHER PUBLICATIONS

Extended European Search Report dated Nov. 10, 2014, issued in corresponding EP application No. 14154906.3 (3 pages).

(Continued)

*Primary Examiner* — William A Rivera
(74) *Attorney, Agent, or Firm* — Westerman, Hattori, Daniels & Adrian, LLP

(57) ABSTRACT

An arm for guiding paper fed along a paper feed path is swingably supported at its base end portion on one side of the winding core. The arm is provided with a free roll, on which the paper is guided to pass onto the winding core. At its free end portion, the arm has a roller rotatably mounted thereon which constitutes a body of rotation contacting with the paper roll so that with the winding core rotated and with the roller pressed against the paper roll the paper may be wound up into the paper roll on the rotating winding core without the occurrence of a paper winding wrinkle, whereby with a distance held constant at all times between the feed roll and the roller along a paper winding path, paper winding without such wrinkling can be achieved to yield a paper roll that is large in its maximum diameter.

15 Claims, 10 Drawing Sheets

(52) U.S. Cl.
CPC .... *B65H 2403/942* (2013.01); *B65H 2801/12* (2013.01); *B65H 2801/15* (2013.01)

(58) Field of Classification Search
USPC ..... 242/547
See application file for complete search history.

(56) References Cited

U.S. PATENT DOCUMENTS

| | | | | | |
|---|---|---|---|---|---|
| 5,039,023 | A * | 8/1991 | Hagens | B65H 18/16 | 242/541.6 |
| 5,474,250 | A * | 12/1995 | Birkmann | B65H 18/16 | 242/547 |
| 5,518,201 | A * | 5/1996 | Hagens | B65H 18/16 | 242/547 |
| 5,597,132 | A * | 1/1997 | Schlatter | B65H 18/26 | 242/547 |
| 6,062,507 | A | 5/2000 | Summey, III | | |
| 6,186,438 | B1 * | 2/2001 | Zeppenfeld | B21C 47/063 | 242/547 |
| 6,382,550 | B1 * | 5/2002 | Aalto | B65H 18/22 | 242/541.3 |
| 2009/0236463 | A1 * | 9/2009 | Izumida | B65H 18/26 | 242/547 |

FOREIGN PATENT DOCUMENTS

| | | |
|---|---|---|
| JP | S62-44085 U | 3/1987 |
| JP | 5-077994 A | 3/1993 |
| JP | 2005-001820 A | 1/2005 |

OTHER PUBLICATIONS

Office Action dated Jun. 29, 2016, issued in counterpart Japanese Patent Application No. 2013-027391, with English translation. (6 pages).

* cited by examiner

BACKGROUND ART

WINDING APPARATUS

BACKGROUND OF THE INVENTION

Technical Field

The present invention relates to a winding apparatus for winding up paper into a paper roll.

Background Art

When printing paper such as a continuous web of paper having been printed on is wound up onto a paper winding shaft (winding core) to form a paper roll thereon, a failure to apply a sufficient amount of tension to the paper gives rise to an inconvenience of resulting in a loosely wound-up paper roll, whereby a paper portion on its peripheral side may axially slip out of position of a paper portion on its core side or in its transport the paper may become unwound.

Especially when printed on by an ink jet recording apparatus, the printed paper insufficiently dried and having a plenty of water content left contained therein becomes softer and more pliable, making itself prone to wrinkle immediately before it is wound up. Since the paper then fails to be adequately wound up intensely or under a sufficient amount of tension, there tends to arise the inconvenience mentioned above.

A winding apparatus is disclosed in JP H05-077994 A in which an attempt is made to prevent the occurrence of winding wrinkles when paper is wound up, by applying an increased tension thereto.

In this winding apparatus as shown in FIG. 1, paper (a film) 1 is guided by a first and a second free roll 2*a* and 2*b* and a winding guide arm 5 which is swingably supported on an swing support member 3 and which is swung thereon with a cylinder actuator 4, the arm 5 having a touch roll 6 rotatably supported at its front free end. While the paper 1 is held pressed by the touch roll 6 against the winding core 7, the winding core 7 is rotated, thereby winding up the paper 1 under an added tension into a paper roll 8 on the winding core 7.

In the conventional winding apparatus cited above, an attempt has been made to avoid the occurrence of a paper winding wrinkle by shortening the distance between the second free roll 2*b* and the touch roll 6 along a paper winding path, e. g. to not more than 500% of a width of the paper 1.

However, the free roll 2*b* in the apparatus of FIG. 1 is positioned not to interfere with the paper roll 8 having the paper 1 wound up to its maximum diameter, i.e. with a paper roll 8 increased in diameter to a maximum. With the paper roll 8' becoming larger in its maximum diameter, the distance between the second free roll 2*b* and the touch roll 6 along the paper winding path may become longer, whereby the free roll 2*b* may not be positioned so as to approach to the touch roll 6 by 500% or less of the width of paper 1, possibly bringing about a winding wrinkle. Note that the distance between the second free roll 2*b* and the touch roll 6 along the paper winding path varies with the diameter of the paper roll 8 and becomes longer as the paper roll 8 grows larger in diameter.

Also, since the arm 5 supporting the touch roll 6 is positioned at the side of the winding core 7 which is opposite to the second free roll 2*b*, the paper roll 8 having the paper wound up to the maximum diameter may, when moved downstream for its removal and restoring the winding core 7, be obstructed by the touch roll 6 and the arm 5, making the removing and restoring operation awkward to perform.

Further, the apparatus is not adapted at all to guide the paper obversely and reversely and so wind it up switchably.

It is an object of the present invention to provide a winding apparatus that can solve such problems as mentioned above.

DISCLOSURE OF THE INVENTION

In accordance with the present invention, there is provided a winding apparatus in which paper fed along a paper feed path is guided by a free roll provided for a swingable arm so as to be passed onto a winding core, the winding core being rotated to wind up the paper into a roll of paper thereon, characterized in that the apparatus comprises:

a swing support member on which the arm is swingably supported at its base end portion so that its free end portion may move towards and away from the winding core, the swing support member being positioned at one of sides of the winding core which is closer to the paper feed path and so that it may not interfere with the paper roll maximized in diameter;

a free roll rotatably mounted on the arm and mid between the base and free and portions so as not to contact with the paper roll maximized in diameter;

a body of rotation mounted at the free end portion of the arm for contacting with the paper roll; and a turning force imparting means for imparting a turning force to the arm to swing it so as to press the body of rotation against the paper roll.

Specifically in a winding apparatus of the present invention as set forth above, on the arm and mid between the base and free end portions there are mounted a first free roll closer to the base end portion and a second free roll closer to the free end portion to provide;

a first paper winding path along which the paper guided by the first free roll is passed onto the winding core so that its reverse side may be in contact with the winding core and a second paper winding path along which the paper guided by the first and second free rolls is passed onto the winding core so that its obverse side may be in contact with the winding core, the first and second paper winding paths being switchable into one from other; and the winding core is adapted to rotate forwards and backwards.

This allows the paper to be wound up obversely and reversely thereon by selecting a manner of passing the paper onto the winding core and a direction in which to rotate the winding core.

Alternatively in a winding apparatus of the present invention as set forth above, on the arm and mid between the base and free end portions there is mounted one free roll to provide a first paper winding path along which the paper guided by the one free roll is passed onto the winding core so that its reverse side may be in contact with the winding core; and a second paper winding path along which the paper guided by the one free roll is passed via the body of rotation onto the winding core so that its obverse side may come into contact with the winding core, the first and second paper winding paths being switchable into one from the other; and the winding core is adapted to rotate forwards and backwards.

This allows the paper to be wound up obversely and reversely by selecting a manner of passing the paper onto the winding core and a direction in which to rotate the winding core.

Specifically in a winding apparatus of the present invention as set forth above, the arm is swingable up to a standby position at which the body of rotation mounted on the arm is parted from the paper roll that has become maximum in diameter; and the arm is provided with a hold means for holding the arm at the standby position.

With the arm swung up to the standby position at which the body of rotation is parted from the paper roll, the body of rotation is made no obstacle to the paper roll when the paper roll is taken out for removal. It becomes easier to take the paper roll away. It is made easier to perform the operation of removal of the paper roll and restoring the winding core and there can be no fear that the body of rotation may damage a surface of the paper roll.

Specifically in a winding apparatus of the present invention as set forth above, the turning force imparting means for swinging the arm includes a balance weight for imparting a turning force in a direction opposite to that in which the arm is turned by its own weight, or a cylinder actuator extendible by means of fluid pressure.

According to the present invention, the distance between a free roll and a body of rotation along a paper winding path is held constant at all times without regard of the diameter of a paper roll growing from small to large. And, the free roll and the body of rotation are mounted commonly on an arm and can even be set in closer vicinity of each other when the paper roll is to reach a large diameter. Hence, the occurrence of a winding wrinkle on paper is prevented if the paper is to be wound up into the paper roll that is large in its maximum diameter.

Also, a swing support member for the arm is positioned on the side of a winding core that is closer to a paper feed path. None of the arm or others is present on the side of a winding core opposite to its paper feed path side, proving a space in which to take out the paper roll readily. Hence, the paper roll can easily be removed and taken out. And, an operation of removing a paper roll and restoring the winding core is rendered easy to perform.

BEST MODES FOR CARRYING OUT THE INVENTION

An explanation is given of a first form of implementation of the present invention.

Figure 1:
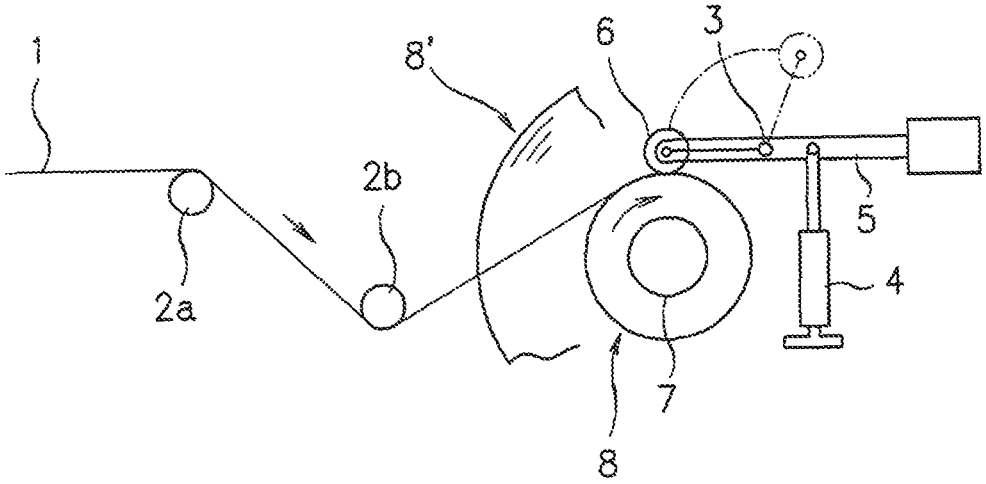
FIG. 1 is an explanatory view of the prior art.
Figure 2:
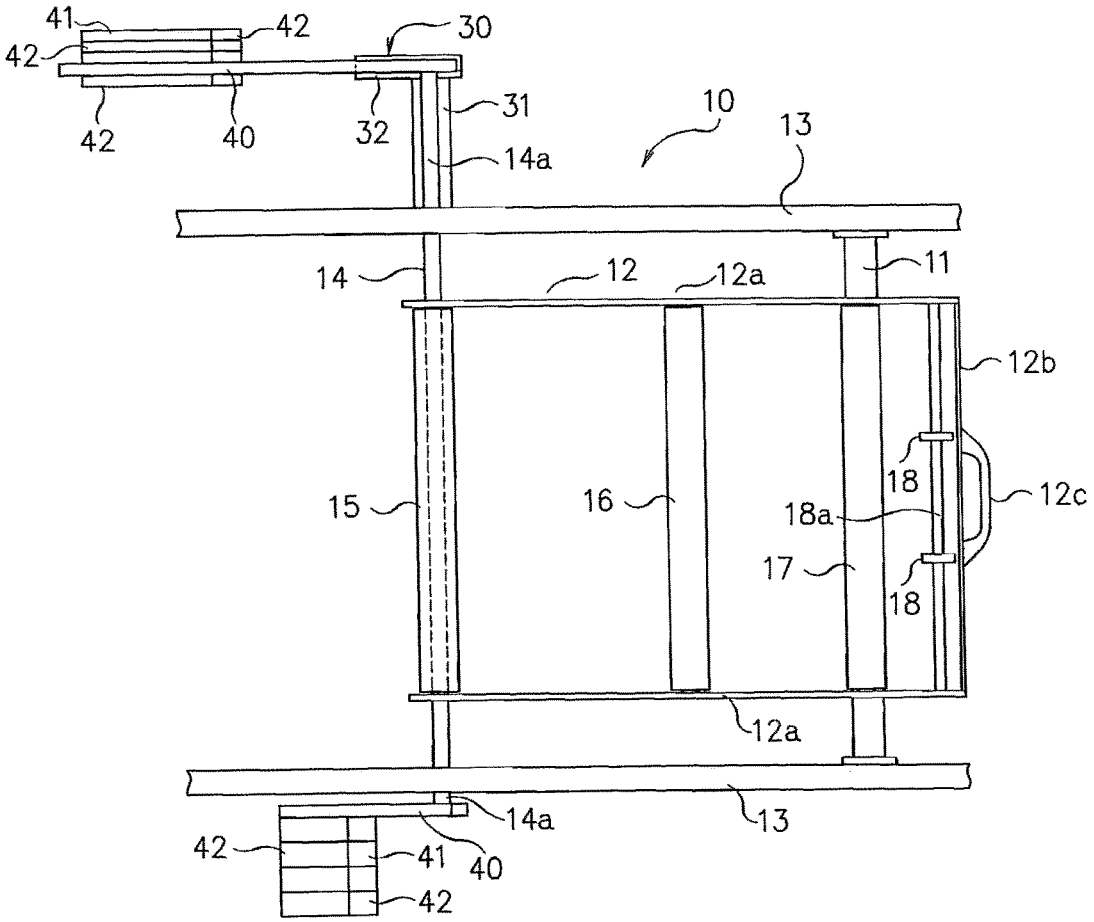
FIG. 2 is a diagrammatic plan view of a winding apparatus representing a first form of implementation of the present invention.

FIG. 2 is a plan view of a winding apparatus. The winding apparatus designated generally by reference character 10 comprises a paper winding core 11 for winding up paper into a paper roll thereon and an arm 12 which is swingable towards the winding core 11.

The winding core 11 is rotatably mounted between a pair of frames 13 and 13 opposed to each other across a width of the paper, the winding core 11 being mounted to and removably from the frames 13. And, the winding core 11 is driven by a drive source such as an electric motor (not shown) to rotate forwards and backwards.

The arm 12 is swingably supported at its base portion by a swing support member, e.g. a supporting shaft 14, in a space between a pair of the frames 13 and 13 and in directions such as to move its front free end portion towards and away from the winding core 11 and so that the free end portion of the arm 12 may be moved towards and away from the winding core 11.

The arm 12 may as shown comprise a pair of arm members 12*a* spaced from each other in the width direction of paper and whose front free ends are connected together by a connecting member 12*b*. The connecting member 12*b* is provided with a handle 12*c*.

The arm 12 has a free roll and a body of rotation, each rotatably mounted thereon, the body of rotation contacting with the paper roll. For example, the free roll comprises a first, a second and a third free roll 15, 16, 17 and the body of rotation or rotary member comprises a roller 18, each of the rolls and the roller being rotatably mounted to the arm 12.

The first free roll 15 is rotatably mounted on the base end portion of the arm 12 coaxially with the supporting shaft 14.

The second free roll 16 is rotatably mounted in a middle between the base and free ends of the arm 12.

The third free roll 17 is rotatably mounted closer to the free end portion of the arm 12.

The first, second and third free rolls 15, 16 and 17 are each long and having a length substantially equal to a maximum width of the paper to be wound up and being rotatably mounted in a space between a pair of the arm members 12*a* and 12*a*.

The roller 18 is short and having a length which may be much shorter than a maximum width of the paper to be wound up. The roller 18 may as shown comprise a pair of rollers 18 and 18 mounted rotatably and spaced apart from each other on a shaft 18*a* between a pair of the arm members 12*a*.

Figure 3:
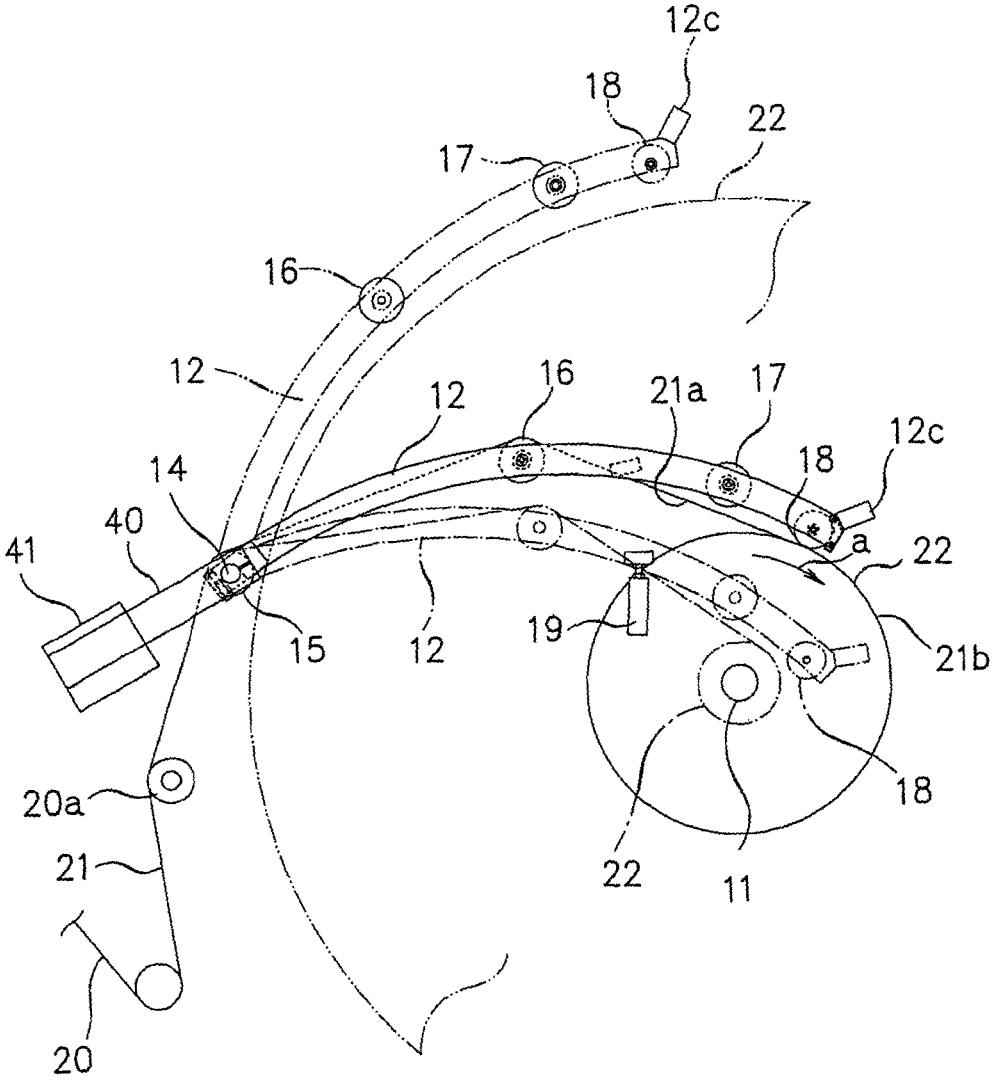
FIG. 3 is a front view of the first form of implementation shown in FIG. 2.

FIG. 3 is a front view of the winding apparatus 10. Fed along a paper feed path 20 and via its most-downstream roll 20*a*, i.e. its outlet, printed paper 21 such as a continuous web of paper in the apparatus is guided by the first and second free rolls 15 and 16 mounted to the swingable arm 12 to pass onto the winding core 11. The winding core 11 is rotated for winding up the paper 21 into a paper roll 22 thereon.

Note that the frames 13 are omitted from illustration in FIG. 3.

And, when the paper 21 is wound up on the rotating winding core 11, the roller 18 as a body of rotation mounted to the free end portion of the arm 12 for contacting with the paper roll is in contact with the paper roll 22 and pressed on the paper roll 22 to develop a localized pressing force, thereby permitting the paper to be wound up so that winding wrinkles may not occur.

To wit, the arm 12 is adapted to be swung by its own weight towards the winding core 11 whereby the roller 18 mounted at the forward end portion of the arm 12 is held under a given pressing force in contact with the paper roll 22 to locally impart the pressing force thereto. And, as the paper 22 becomes larger in diameter than a given value, the arm 12 is adapted to be swung apart from the winding core 11.

Note here that the own weight of the arm 12 includes a weight of the arm 12, those of the second and third free rolls 16 and 17 and that of the roller 18.

Swinging the arm 12 around the supporting shaft 14 in this manner moves the roller 18 close to and away from the winding core 11 and into contact with the paper roll 22 while moving the second free roll 16 close to and away from the winding core 11 but not into contact with the paper roll 22.

Also, since the distance between the second free roll 16 and the roller 18 along a paper winding path is always constant and maintained unvaried if the paper roll 22 is varied in its maximum diameter, winding wrinkles may not occur on the paper roll 22 if paper is wounded up into the paper roll 22 which is large in the maximum diameter.

The supporting shaft 14 as the swing support member for the arm 12 is positioned outside of, and close to, the paper roll 22 maximized in diameter. To wit, it is positioned, not to interfere with, but close to, the paper roll 22 maximized in diameter.

The first free roll 15 is held at all times at a fixed position (a center of swing of the arm 12) and not to interfere with the paper roll 22 maximized in diameter.

Yet, the supporting shaft 14 for the arm 12 and the first free roll 15 are positioned at a side of the paper feed path 20, namely at a paper feed-in side, with respect to the winding core 11. On the side of the winding core 11 which is opposite to the paper feed path 20 there is no arm 12 and no supporting shaft 14, providing a space through which the roll paper 22 can readily be taken out.

Consequently, when the paper roll 22 is taken out, namely at the time of its removal, none of the supporting shaft 14, the first, second and third free rolls 15, 16 and 17, the roller 18 and the arm 12 itself can constitute any obstacle to the paper roll 22. The operation of removing the paper roll 22 and restoring the winding core 11 is rendered easy to perform.

Figure 4:
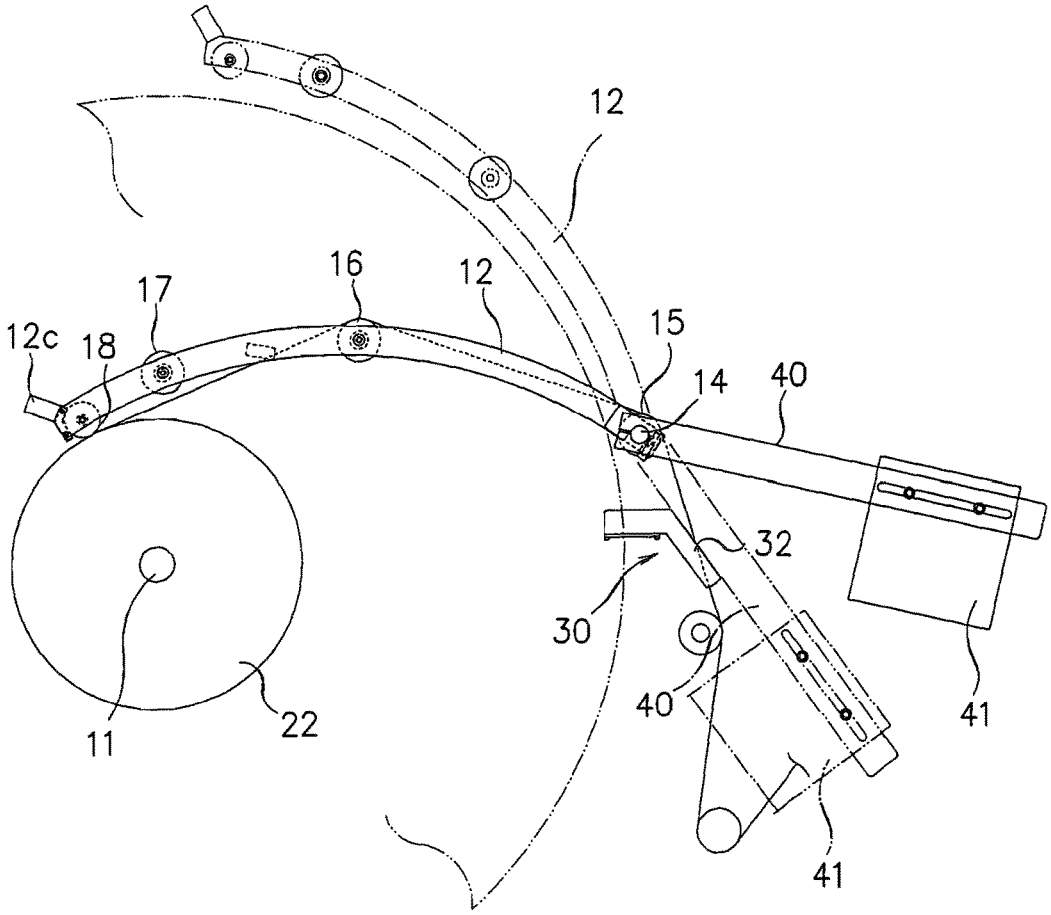
FIG. 4 is a rear view of the first form of implementation shown in FIG. 2.

In this form of implementation, a hold means 30 as shown in FIG. 4 is provided for holding the arm 12 at a standby position indicated by a phantom line in FIGS. 3 and 4. Note that in FIG. 4, too, the frames 13 are omitted from illustration.

And, when the arm 12 is at a standby position, the roller 18 as the body of rotation or rotary member for contacting with the paper roll 22 is positioned outside of the paper roll 22 of the maximum diameter indicated by the phantom line and apart from and out of contact with the surface of the paper roll 22 of the maximum diameter.

So positioned, the roller 18 is made no obstacle to the paper roll 22 when it is taken out. It becomes easier to take the paper roll 22 away. It is made easier to perform the operation of removing the paper roll and restoring the paper winding core 11 and there can be no fear that the roller 18 may damage a surface of the paper roll 22.

In this form of implementation, in order that the roller 18 as the body of rotation contacting with the paper roll 22 may be pressed against the paper roll 22, there is provided a turning force imparting means for imparting a turning force to the arm 12 to swing it towards the winding core 11, thereby pressing the roller 18 against the paper roll 22 under a predetermined pressing force.

In this form of implementation, a first turning force is imparted to the arm 12 by the gravity of its own weight to move its free ends portion towards the paper winding core 11. And, a second turning force as is seen from FIGS. 2, 3 and 4 is imparted to the arm 12 by the gravity of a balance weight 41 mounted on a balance weighting lever 40 securely connected to each of both ends 41*a* of the supporting shaft 14 which project from the frames 13, the second turning force imparted to the arm 12 moving its free end portion away from the paper roll 22.

And, the first turning force is greater than the second turning force, a difference between them in turning force representing a pressing force applied to the roller 18 against the paper roll 22.

To wit, a large turning force by the own weight of the arm 12 which is excessive as a pressing force of the roller 18 against the paper roll 22 is reduced by the balance weight 41 to provide an appropriate pressing force from the roller 18 onto the paper roll 22.

And, changing the balance weight 41 makes it possible to adjust the pressing force from the roller 18 onto the paper roll 22.

For example, the balance weighting lever 40 may also be provided with a plurality of additional weights 42 removably whose number in gravitational quantity selected can be varied, and/or with a replacement weight 42 different in gravity to increase and decrease the gravity of the balance weight 41.

The winding apparatus according to this form of implementation is provided with a stopper 19 that limits swinging of the arm 12 towards the winding core 11 where the winding core 11 is very small in diameter as indicated by the dashed dotted line in FIG. 3 to prevent the arm 12 and the roller 18 from contacting with the paper roll 22 and the winding core 11 when the paper 21 is wound around the winding core 11.

The hold means 30 as shown in FIGS. 2 and 4 comprises a magnet 32 mounted via a spacer 31 to one of the frames 13 wherein the arm 12 swinging to the standby position causes the arm balancing weighting lever 40 to be attracted to the magnet 32, thereby holding the arm 12 at the standby position.

The hold means 30 is not limited to that shown and described but may be any one as desired.

For example, it may be one in which a lock pin is inserted out of a bore in the lever 40 into a hole in the one frame 13, one in which the lever 40 is fixed by a bolt to the frame 13, or the like.

In FIG. 2, the arm 12 is diagrammatically shown. Mention is now made of a specific configuration of the arm 12 with reference to FIG. 5.

Figure 5:
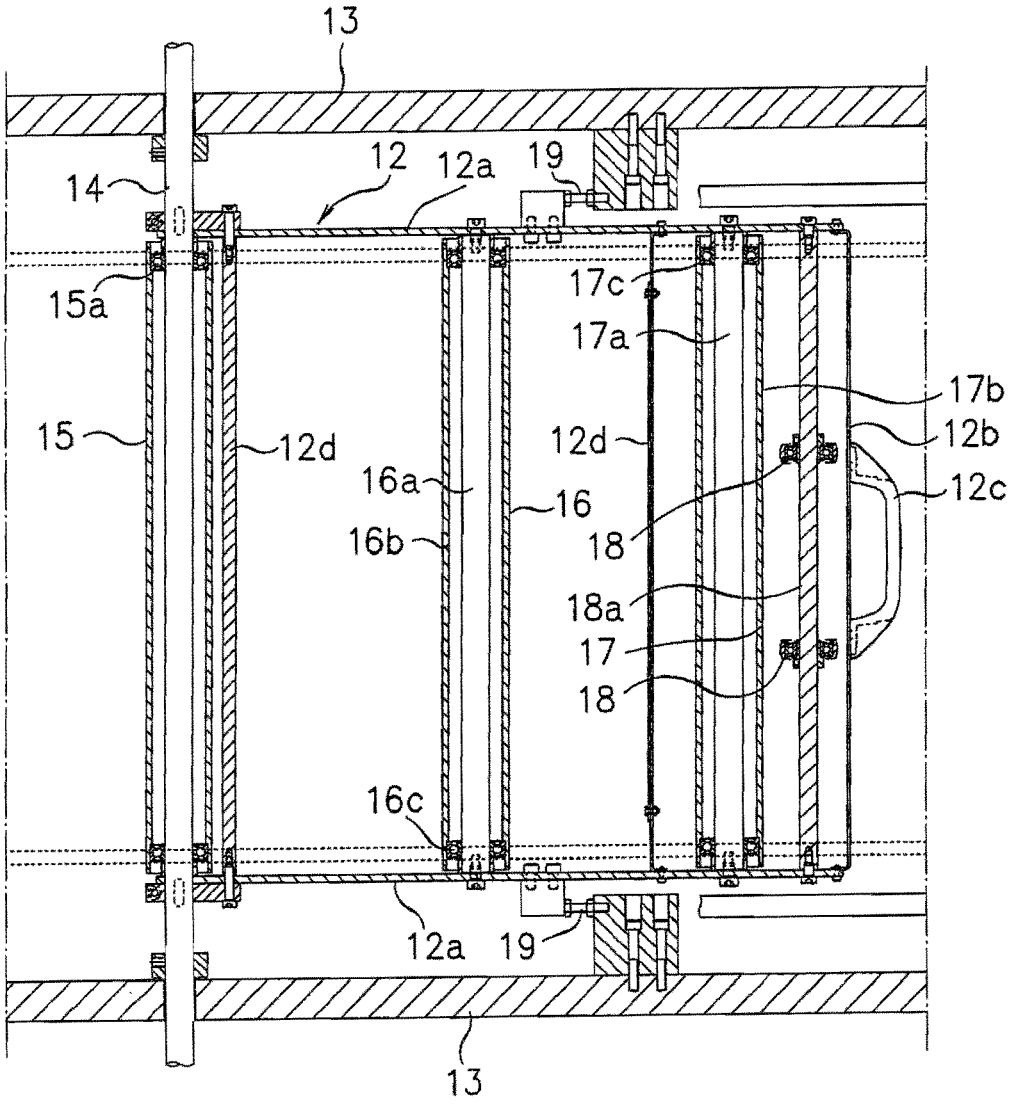
FIG. 5 is a detailed sectional view of an arm part in the first form of implementation.

The arm 12 as shown in FIG. 5 comprises a pair of arm members 12*a* and 12*a* each of which has one longitudinal end secured to a supporting shaft 14. A plurality of stays 12*d* are fastened to and between a pair of the arm members 12*a* and 12*a*.

A first free roll 15 is cylindrical and rotatably supported by the supporting shaft 14 via a bearing 15*a*.

A second free roll 16 has a cylindrical member 16*b* rotatably supported via a bearing 16*c* by a shaft 16*a* fastened to and between a pair of the arm members 12*a* and 12*a*.

A third free roll 17 has a cylindrical member 17*b* rotatably supported via a bearing 17*c* by a shaft 17*a* fastened to and between a pair of the arm members 12*a* and 12*a*.

The arm 12 having the second and third free rolls 16 and 17 mounted thereon allows the paper 21 to be wound up onto the winding core 11 either obversely or reversely.

For example, a first paper winding path as shown in FIG. 3 for obverse winding is formed in which a reverse side 21*a* of the paper 21 is contacted with surfaces of the first and second free rolls 15 and 16 and wound around the winding core 11 so as to be in contact therewith. Then, the paper 21 of which the reverse side 21*a* is in contact with the winding core 11 is wound up onto the winding core 11 or the paper thereon when the winding core 11 is rotated in the direction of the arrow a.

The paper 21 of which the reverse side 21*a* is contacted with the winding core 11 or the paper thereon while its obverse side 21*b* is exposed is thereby obversely wound up onto the winding core 11 or the paper thereon.

Figure 6:
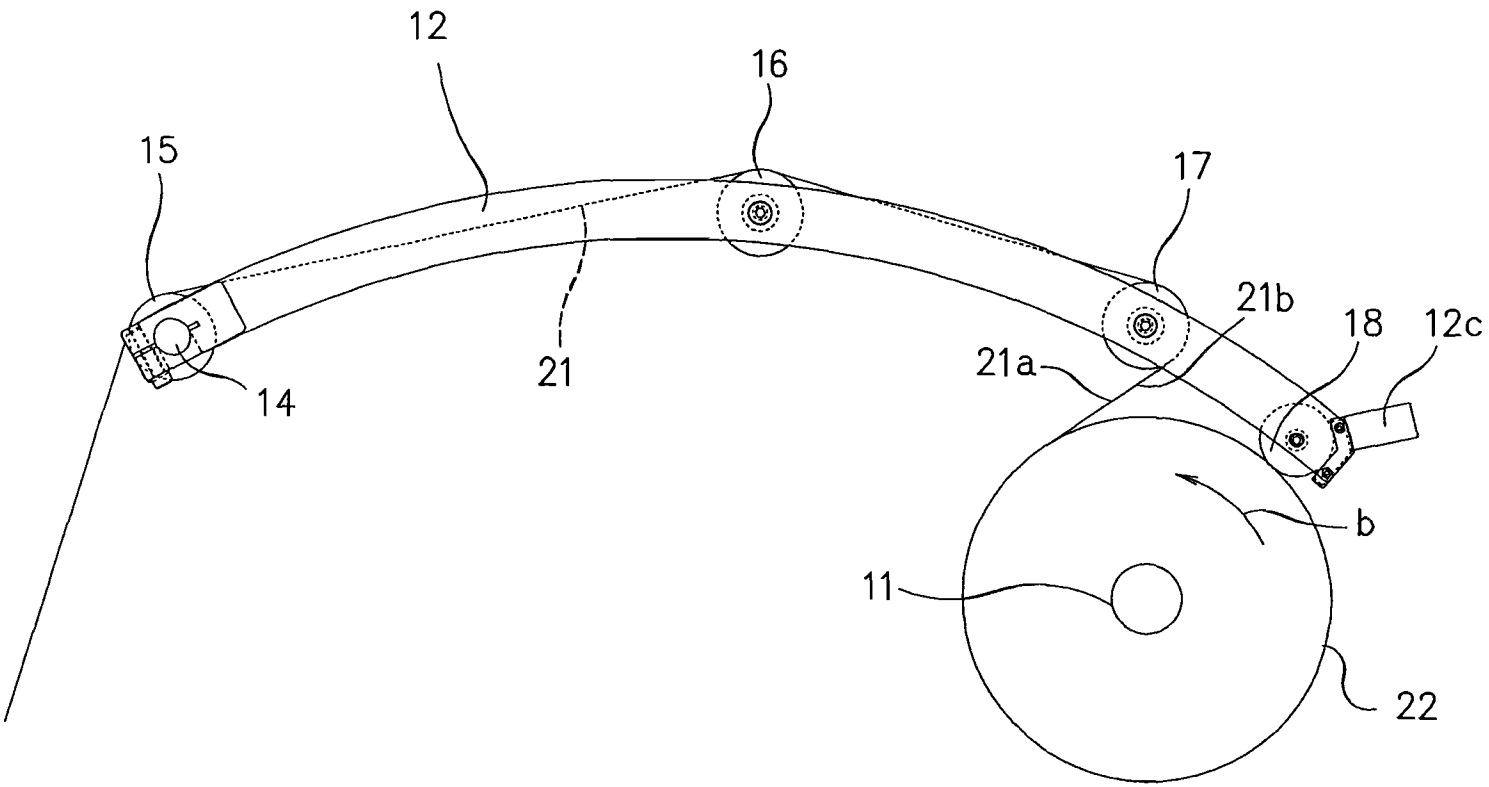
FIG. 6 is an explanatory view of operation of winding paper reversely in the first form of implementation of the invention.

For reverse winding, a second paper winding path as shown in FIG. 6 is formed in which the reverse side 21*a* of the paper 21 is contacted with the first, second and third free rolls 15, 16 and 17 successively. Passing the third fee roll 17, then, the paper 21 of which the obverse side 21*b* is wound around the winding core 11 so as to be in contact with the core 11 is wound up onto the winding core 11 or the paper thereon when the winding core 11 is rotated in the direction of the arrow b.

The body of rotation contacting with the paper roll is constituted by a pair of short rollers 18 in this form of implementation. The area in which they contact with the paper roll 22 is small and so is the force under which they are pressed against the paper roll 22. If the paper 21 is paper printed on, then, it is unlikely that printing ink on a printed side of the paper 21 may be transferred onto its opposite side.

Mention is made of a second form of implementation of the present invention.

Figure 7:
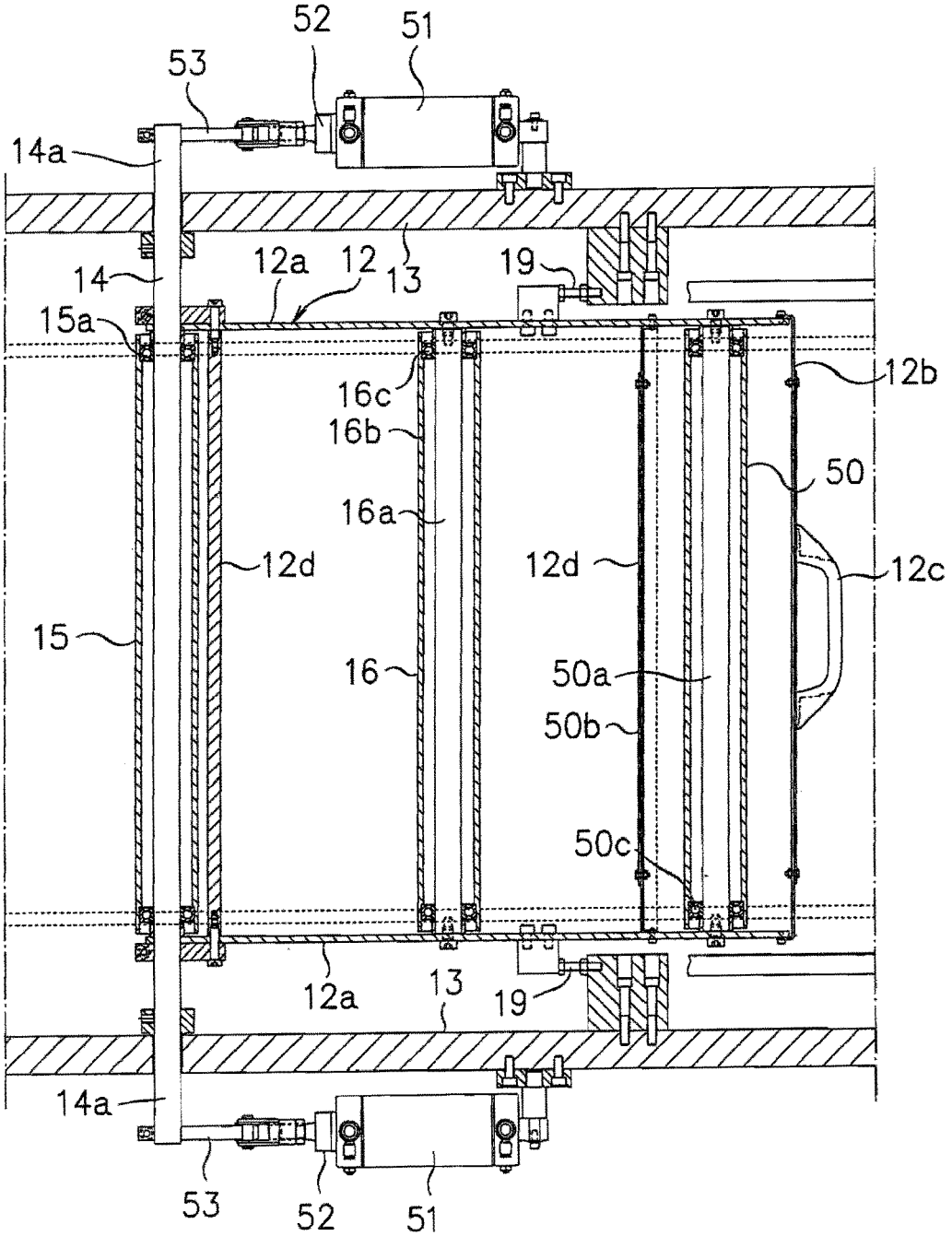
FIG. 7 is a cross-sectional view of a winding apparatus representing a second form of implementation of the present invention.
Figure 8:
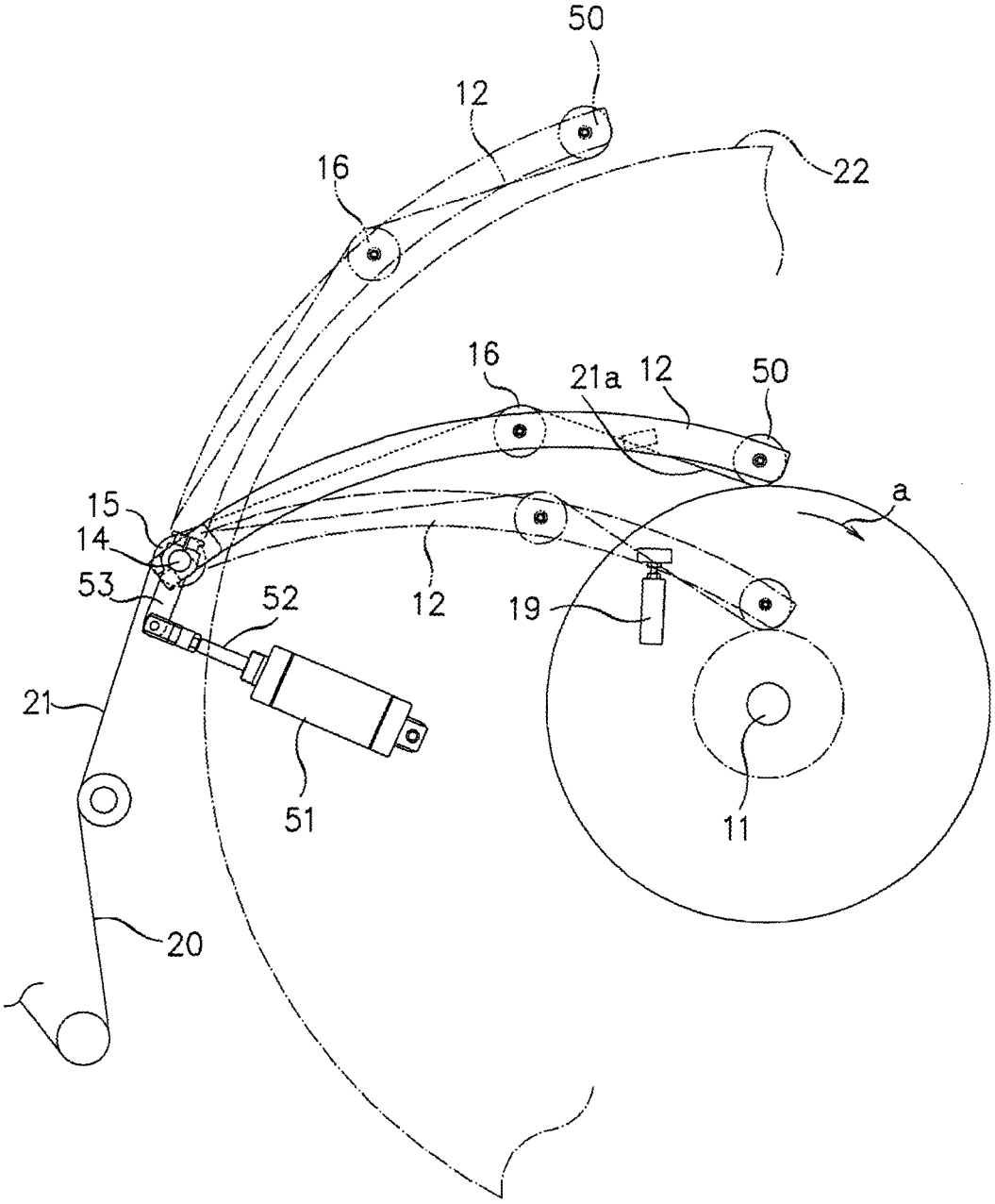
FIG. 8 is a front view of the second form of implementation shown in FIG. 7.

In FIGS. 7 and 8, the arm 12 is shown provided with the first and second free rolls 15 and 16 and a touch roll 50 which is identical in length to the free rolls and constitutes the body of rotation contacting with the paper roll.

To wit, the touch roll 50 comprises a cylinder 50*b* which is mounted rotatably with a bearing 50*c* on a shaft 50*a* attached between a pair of the arm members 12*a* and 12*a*, the cylinder 50*b* being identical in length to the cylinders of the first and second free rolls 15 and 16.

In this form of implementation, the turning force imparting means for imparting a turning force to the arm 12 to swing it comprises a cylinder actuator 51 swingably mounted on each of the frames 13 and having an extendible part 52. The extendible part 52 is swingably connected via a pin or the like to a lever 53 fastened to each of the ends 14*a* of the supporting shaft 14 which project from the frames 13, respectively. The cylinder actuator 51 is supplied controllably with pressure fluid to extend and retract the extendible part 52, thereby swinging the arm 12 around the supporting shaft 14 towards and away from the winding core 11.

Pressure fluid, e.g. compressed air, from a fluid pressure source (air generator) is supplied into one of an extension and a retraction chamber of the cylinder actuator 51 from the other of which pressure fluid is discharged. The extendible part 52 acts to be extended to swing the arm 12 towards the winding core 11, thereby pressing the touch roll 50 onto the paper roll 22 under a predetermined force. As the paper roll 22 grows larger in diameter, the extendible part 52 acts to be retracted to swing the arm 12 away from the winding core 11.

This allows the hold means 30 for holding the arm 12 at the standby position to be constituted by the cylinder actuator 51 as well.

For example, when the paper roll 22 becomes maximum in diameter, the cylinder actuator 51 is operated to retract the extendible part 52 to swing the arm 12 up to the standby position and then held to hold the arm 12 at the standby position.

In this form of implementation in which to wind paper 21 obversely, a first paper winding path is provided along which the paper 21 as shown in FIG. 8 is guided by the first and second free rolls 15 and 16 and wound around the winding core 11 so that its reverse side may be in contact therewith. And then the paper 21 is wound up onto the winding core 11 or the paper thereon when the winding core 11 is rotated in the direction of the arrow a.

Figure 9:
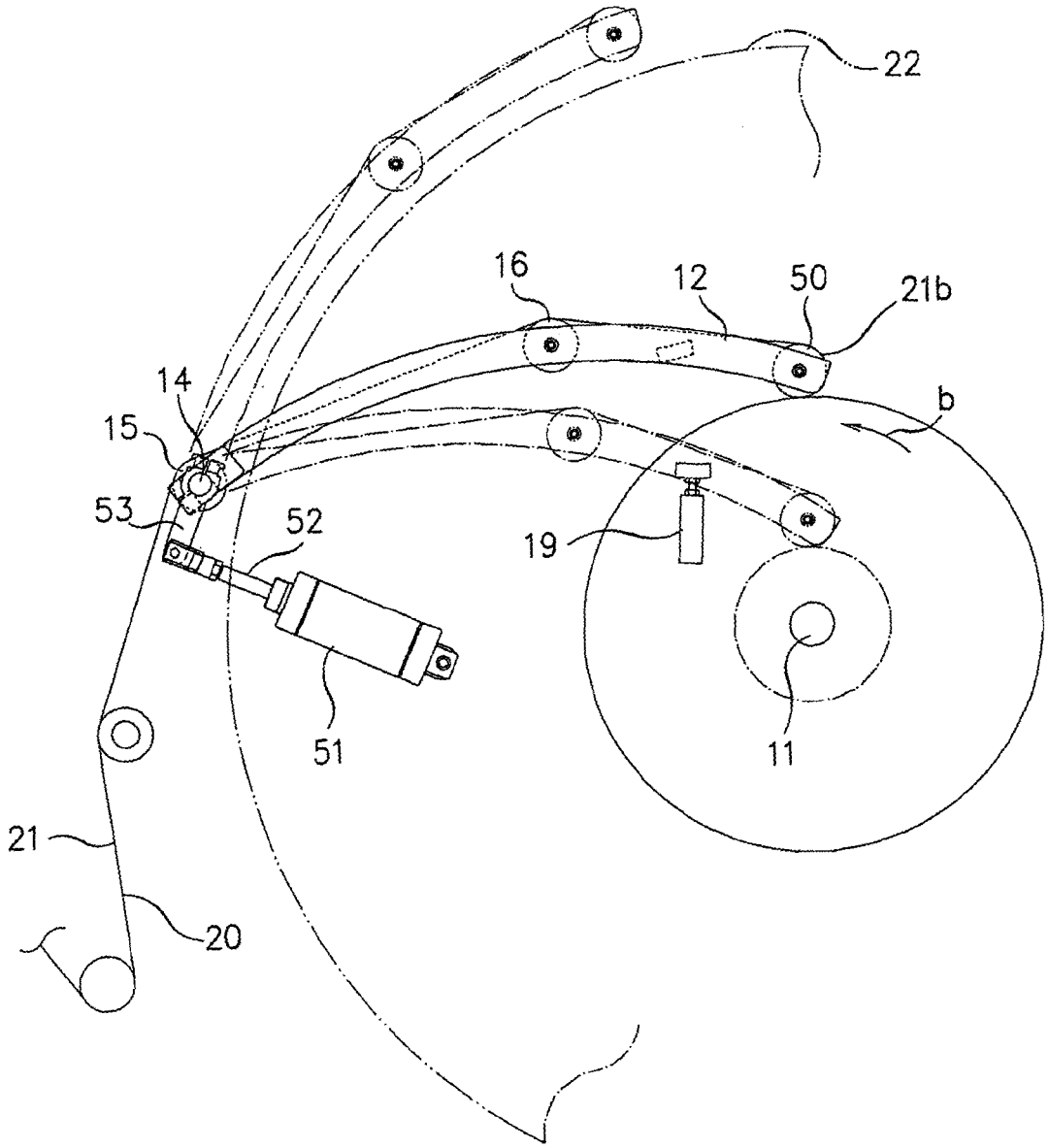
FIG. 9 is an explanatory view of operation of winding paper reversely in the second form of implementation of the invention.

To wind paper 21 reversely, a second paper winding path is provided along which the paper 21 as shown in FIG. 9 is guided by the first and second free rolls 15 and 16 and wound around the touch roll 50 and then wound around the winding core 11 so that its obverse side 21*b* may be in contact therewith. And then the paper 21 is wound up onto the winding core 11 or the paper thereon when the winding core 11 is rotated in the direction of the arrow b.

In the first form of implementation mentioned above, in lieu of the balance weight 41 the cylinder actuator 51 may be used to impart the turning force to the arm 12. And, in the second form of implementation, in lieu of the cylinder actuator 51 the balance weight 41 may be used to impart the turning force to the arm 12.

Figure 10:
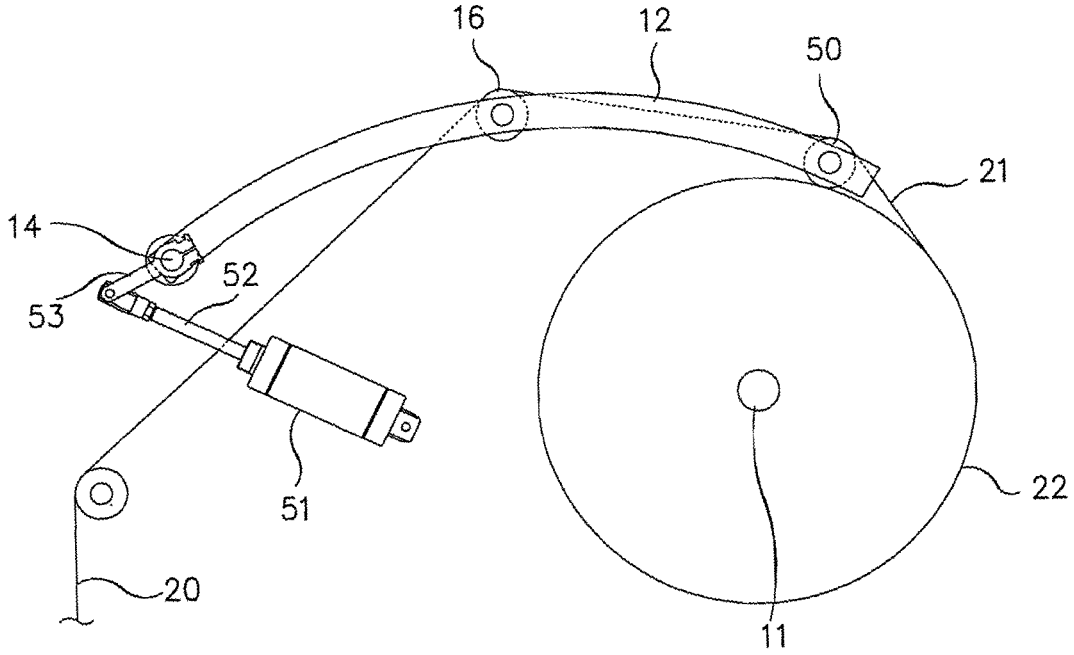
FIG. 10 is an explanatory view of a different embodiment of paper pass-through in the second form of implementation of the present invention.

While in each of the forms of implementation illustrated and described above, the paper 21 is guided by the first free roll 15 to pass on the second free roll 16, the paper 21 exiting the paper feed path 20 as shown in FIG. 10 may directly be passed on the second free roll 16 mounted on the arm 12. This makes the first free roll 15 unnecessary.

In this case in the second form of implementation, the paper 21 from the second roll 16 can via the touch roll 50 be wound up obversely onto the winding core 11.

What is claimed is:

1. A winding apparatus in which paper fed along a paper feed path is guided by a free roll provided for a swingable arm so as to be passed onto a winding core, the winding core being rotated to wind up the paper into a roll of paper thereon, characterized in that the apparatus comprises:

a swing support member on which said arm is swingably supported at its base end so that its free end is moved towards and away from said winding core, the swing support member being positioned at one side of the winding core which is closer to the paper feed path and so that it does not interfere with the paper roll maximized in diameter;

said free roll rotatably mounted on said arm between said base end and said free end so as not to contact with the paper roll maximized in diameter;

a body of rotation mounted at said free end of the arm for contacting with said paper roll, wherein said free roll and said body of rotation are fixedly supported on said arm such that a distance between said free roll and said body of rotation is maintained constant; and a turning force imparting means for imparting a turning force to said arm to swing it so as to press said body of rotation against said paper roll, wherein the paper feed path of said winding apparatus extends in a first feed direction from proximate said base of said swingable arm to an upper side of said free roll and then extends in a second feed direction that is at a bending angle from said first feed direction downwards towards said free end, and wherein said swingable arm is arc shaped.

2. A winding apparatus as set forth in claim 1, in which:

on said arm between said base end and said free end there are mounted as said free roll one free roll closer to said base end and the other free roll closer to said free end to provide:

a first paper winding path along which the paper guided by the one free roll is passed onto the winding core so that its reverse side may be in contact with said winding core; and a second paper winding path along which the paper guided by the one and the other free rolls is passed onto the winding core so that its obverse side may be in contact with said winding core, said first and second paper winding paths being switchable into one from other; and said winding core is adapted to rotate forwards and backwards.

3. A winding apparatus as set forth in claim 2, in which:

said arm is swingable up to a standby position at which said body of rotation mounted on the arm is parted from the paper roll that has become maximum in diameter; and said arm is provided with a hold means for holding the arm at said standby position.

4. A winding apparatus as set forth in claim 2, in which said turning force imparting means for swinging the arm includes a balance weight for imparting a turning force in a direction opposite to that in which the arm is turned by its own weight.

5. A winding apparatus as set forth in claim 2, in which said turning force imparting means for swinging the arm includes a cylinder actuator extendable by means of fluid pressure.

6. A winding apparatus as set forth in claim 1, in which:

on said arm and between said base and free end portions there is mounted one free roll to provide:

a first paper winding path along which the paper guided by the one free roll is passed onto the winding core so that its reverse side may be in contact with said winding core; and a second paper winding path along which the paper guided by the one free roll is passed via said body of rotation onto the winding core so that its obverse side may be in contact with the winding core, said first and second paper winding paths being switchable into one from the other; and said winding core is adapted to rotate forwards and backwards.

7. A winding apparatus as set forth in claim 6, in which:

said arm is swingable up to a standby position at which said body of rotation mounted on the arm is parted from the paper roll that has become maximum in diameter; and said arm is provided with a hold means for holding the arm at said standby position.

8. A winding apparatus as set forth in claim 6, in which said turning force imparting means for swinging the arm includes a balance weight for imparting a turning force in a direction opposite to that in which the arm is turned by its own weight.

9. A winding apparatus as set forth in claim 6, in which said turning force imparting means for swinging the arm includes a cylinder actuator extendable by means of fluid pressure.

10. A winding apparatus as set forth in claim 1, in which:

said arm is swingable up to a standby position at which said body of rotation mounted on the arm is parted from the paper roll that has become maximum in diameter; and said arm is provided with a hold means for holding the arm at said standby position.

11. A winding apparatus as set forth in claim 10, in which said turning force imparting means for swinging the arm includes a balance weight for imparting a turning force in a direction opposite to that in which the arm is turned by its own weight.

12. A winding apparatus as set forth in claim 10, in which said turning force imparting means for swinging the arm includes a cylinder actuator extendable by means of fluid pressure.

13. A winding apparatus as set forth in claim 1, in which said turning force imparting means for swinging the arm includes a balance weight for imparting a turning force in a direction opposite to that in which the arm is turned by its own weight.

14. A winding apparatus as set forth in claim 1, in which said turning force imparting means for swinging the arm includes a cylinder actuator extendable by means of fluid pressure.

15. A winding apparatus as set forth in claim 1, wherein said arc shape of said swing arm is sized to extend around a maximum diameter of the paper roll.

* * * * *